US007235961B1

(12) United States Patent
Penza et al.

(10) Patent No.: US 7,235,961 B1
(45) Date of Patent: Jun. 26, 2007

(54) METHOD FOR MANAGING CORROSION OF AN UNDERGROUND STRUCTURE

(75) Inventors: G. Gregory Penza, Huntington, NY (US); Joseph T. Mandara, Middletown, NY (US); Philip J. Fowles, North Merrick, NY (US)

(73) Assignees: ULC Robotics, Inc., Deer Park, NY (US); Consolidated Edison Company of New York, New York, NY (US)

( * ) Notice: Subject to any disclaimer, the term of this patent is extended or adjusted under 35 U.S.C. 154(b) by 0 days.

(21) Appl. No.: 11/395,016

(22) Filed: Mar. 31, 2006

(51) Int. Cl.
*G01N 27/00* (2006.01)
*C23F 13/00* (2006.01)

(52) U.S. Cl. ..... 324/71.1; 205/734; 204/196.36; 204/196.21

(58) Field of Classification Search ..... 205/734; 204/196.36, 196.21
See application file for complete search history.

(56) References Cited

U.S. PATENT DOCUMENTS

| | | | | |
|---|---|---|---|---|
| 3,578,982 | A | 5/1971 | Nelson | |
| 4,255,241 | A | 3/1981 | Kroon et al. | |
| 4,442,903 | A | 4/1984 | Schutt et al. | |
| 4,681,489 | A | 7/1987 | Millauer et al. | |
| 4,812,212 | A | 3/1989 | Dimond et al. | |
| 5,080,773 | A * | 1/1992 | Tatum et al. | 204/196.34 |
| 5,505,826 | A * | 4/1996 | Haglin et al. | 205/731 |
| 6,059,908 | A * | 5/2000 | Van Beersel | 156/86 |
| 6,279,617 | B1 * | 8/2001 | Havn | 138/155 |
| 6,328,877 | B1 * | 12/2001 | Bushman | 205/775 |
| 6,332,971 | B1 * | 12/2001 | Hill | 205/734 |
| 6,508,349 | B1 | 1/2003 | Lewin | |
| 6,572,760 | B2 * | 6/2003 | Whitmore | 205/734 |
| 2004/0238376 | A1 * | 12/2004 | Whitmore | 205/734 |

* cited by examiner

*Primary Examiner*—Anjan Deb
*Assistant Examiner*—Jeff Natalini
(74) *Attorney, Agent, or Firm*—Brooks Kushman P.C.

(57) ABSTRACT

A method for managing corrosion of an underground structure includes placing an anode in the ground and electrically connecting it to the underground structure. Access to the ground is obtained through a container at least partially buried in the ground, such that the surface of the ground proximate the container does not need to be penetrated in order to position the anode. A hole is bored through a wall of the container to access the ground proximate the container. Material is removed from the ground to provide a location for the anode. The anode is placed in the ground and backfilled with an electrically conductive backfill. A wire leading from the anode is then terminated inside the container at an electrical connection with another electrical conductor connected to the underground structure. The lid is replaced on the container, and the entire process is performed without penetrating the surface of the ground proximate the container.

20 Claims, 2 Drawing Sheets

METHOD FOR MANAGING CORROSION OF AN UNDERGROUND STRUCTURE

BACKGROUND OF THE INVENTION

1. Field of the Invention

The present invention relates to a method for managing corrosion of an underground structure, and in particular, it relates to a method for installing an anode to protect an underground metal pipeline.

2. Background Art

Corrosion, and in particular corrosion of metal structures, is a problem that must regularly be addressed in a wide variety of areas. For example, in the automotive industry, metal parts are often plated or coated to protect them from road salt and moisture in hopes of increasing their longevity. Indeed, many traditionally metal parts are currently being replaced with polymeric components, which are not only lighter and perhaps more cost effective to produce, but are generally impervious to electrochemical corrosion often experienced by metals.

Other industries have also employed non-metal structures, or at least coated metal structures. For example, new installations of natural gas delivery systems may include wrapped steel gas pipelines to help inhibit corrosion. These coated steel pipelines generally have a much longer expected life span than their bare steel counterparts; however, the coating on the wrapped steel pipelines will eventually degrade. Moreover, many hundreds or thousands of miles of pipeline were installed before wrapped steel pipe was readily available. Therefore, corrosion of existing pipeline structures—and eventually, corrosion of recently-laid wrapped pipeline structures—present an ongoing challenge for those working in the gas industry.

One way in which this problem has been addressed is through the use of cathodic protection for the steel pipelines. In its simplest form, cathodic protection includes the use of a galvanic couple—i.e., the metal to be protected is electrically connected to another metal that is more anodic than the metal to be protected. The anode becomes sacrificial, giving up electrons in an oxidation reaction. In this situation, the metal to be protected becomes a cathode, experiencing a reduction reaction which protects the metal.

In the case of an underground steel pipeline, it has been common practice to bury an anode rod in proximity to the pipeline, and connect the rod and the pipeline together with an electrical conductor, such as a copper wire. Because these pipelines may remain in the ground for decades, and because the anode can, over time, experience significant deterioration, it is important to be able to determine if a particular anode remains an effective corrosion inhibitor for the pipeline. One way this is accomplished is by terminating the connection between the anode and the pipeline in a test box, sometimes called a "curb box". The test box is usually located near the surface of the ground, and has a top cover which can be removed to provide access to the interior of the box. In the box, a wire leading from the pipeline is attached to a wire leading from the anode. By placing a volt meter in between these wires and measuring the voltage potential, the relative effectiveness of the anode can be determined. When it is determined that an anode has deteriorated beyond the point at which it continues to be effective to inhibit corrosion of the steel pipeline, a new anode is required.

In practice, the existing anode may be allowed to remain, while a second anode is installed. Although the electrical connection to the pipeline is made inside the test box, installing the anode in the ground can be very expensive, time consuming, and disruptive. One particularly onerous aspect of installing a new anode to protect an underground pipeline is the cost of the relatively large excavation project that is used to place the new anode in the ground near the test box. Test boxes are sometimes located in sidewalks, or along the edges of busy thoroughfares. In cases such as these, it is common for a municipality to require the purchase of a permit to break through the concrete or asphalt surrounding the test box. In addition to the purchase price of the permit, it may be necessary for the construction company to post a bond. Drawings of the proposed excavation and placement of the anode may need to be submitted, and additional fees are often required.

The administrative costs for such a project in a large city, for example New York City, may total a thousand dollars or more. For a large utility, which may place hundreds of anodes along miles of pipeline each year, these costs represent a huge expense. In addition, there is the equipment required for the excavation project itself, which may include a jack hammer, or other impact device, and a backhoe, or other removal equipment, needed to dig the hole and remove the debris after the concrete or asphalt surface is penetrated. Such a project is not only expensive and time consuming for the company performing it, but is also disruptive to the public. A typical excavation to place an anode is loud, time consuming, and may cause traffic—pedestrian and/or vehicle traffic—to be rerouted, not only while the anode is being installed, but afterward during the time the newly-poured replacement concrete or asphalt sets-up.

Therefore, a need exists for a method for managing corrosion of an underground structure, and in particular a method for installing an anode for a steel pipeline that does not require destruction of a paved surface surrounding a test box, with all of its attendant costs and disruptions.

SUMMARY OF THE INVENTION

Accordingly, embodiments of the present invention include a method for managing corrosion of an underground structure that does not require the pavement surface to be penetrated in order to bury a sacrificial anode in the ground.

The invention also provides a method for managing corrosion of an underground structure that includes a pipeline having an electrically conductive apparatus electrically connected to it. At least a portion of the electrically conductive apparatus is disposed in a container at least partially disposed below ground. The container includes a wall and a removable cover for selectively covering and providing access to an interior of the container. The method includes removing the cover of the container and boring a hole through the wall of the container. The boring is initiated from the interior of the container. Material is removed from the ground proximate the container through the hole in the wall. This creates a hole of a certain depth in the ground adjacent the container without having to penetrate a top surface of the ground proximate the container. An anode for the pipeline is at least partially inserted into the hole of the certain depth from the interior of the container. This effects placement of the anode in the ground adjacent the container without having to penetrate a top surface of the ground proximate the container. The anode is then electrically connected to the electrically conductive apparatus.

The invention further provides a method for managing corrosion of an underground structure that includes a pipeline having a first anode electrically connected thereto. The pipeline has an electrical conductor electrically connected to it, at least a portion of which is disposed in a test box at least partially disposed below ground. The test box includes a wall and a removable cover for selectively covering and providing access to an interior of the test box. The method includes removing the cover of the test box and creating a hole of a certain depth in the ground adjacent the container by boring through the wall of the test box from its interior, and removing material from the ground proximate the test box through the bored hole. The hole of the certain depth is created without having to penetrate a top surface of the ground proximate the container. A second anode for the pipeline is at least partially disposed within the hole of the certain depth, and electrically connected to the electrical conductor.

The invention also provides a method for managing corrosion of an underground structure having a first electrically conductive apparatus electrically connected thereto. At least a portion of the first electrically conductive apparatus is disposed in a container that is at least partially below ground. The container has an interior which is at least partially defined by a wall. The method includes accessing the interior of the container, thereby providing access to the wall and the first electrically conductive apparatus. A hole is created in the wall of the container, thereby providing access to the ground proximate the container adjacent the hole in the wall. A hole of a certain depth is created in the ground adjacent the hole in the wall by accessing the ground through the hole in the wall from the interior of the container. This creates the hole of the certain depth without having to penetrate a top surface of the ground proximate the container. A second electrically conductive apparatus is at least partially disposed within the hole of the certain depth. The second electrically conductive apparatus includes a material capable of acting as an anode relative to the underground structure. The first and second electrically conductive apparatuses are electrically connected to each other.

The present invention provides considerable advantages over existing methods of installing an anode and attaching it to a steel pipeline. In the case of installing an anode for a pipeline where a previously installed anode is connected to the pipeline in a test box, the test box provides access to the subsurface ground where the new anode will be located. A test box such as this will often be located near an edge of a roadway, which may be asphalt or concrete. A top cover of the test box will usually be at or near ground level, and it will not be covered with the road surface material. Therefore, an interior portion of the test box can be accessed by removing the cover, which does not require penetration of the roadway surface.

By accessing subsurface ground through the interior of the test box, the present invention contemplates positioning an anode below ground without disrupting the surface of a surrounding roadway. In one embodiment, a core drill is used to bore through a side of the test box, the bottom of the test box, or some combination thereof. The core drill is then used to bore a hole through some of the roadway surrounding the test box. This provides access to the soil and other ground materials, which are removed by some effective method, such as digging or vacuuming. This provides a location for placement of an anode, such as a magnesium rod. An electrically conducting wire is secured to the top end of the rod, such that the wire can be connected to the pipeline—and also the first anode—by tapping into the existing connection in the test box.

The core drill may be angled as it bores through the side of the test box and the roadway surrounding the test box, such that it is not oriented horizontally or vertically. This provides a number of advantages. For example, depending on the diameter of the core drill used, and the location of the existing wires in the test box, drilling vertically through the floor of the test box may be difficult or impossible because of interference with the wires. Conversely, drilling horizontally through a sidewall of the test box would be difficult since the interior of the box itself may be relatively small, and the core drill relatively long.

In addition to other advantages, drilling through the test box at some oblique angle to the vertical, and creating a hole in the ground at approximately the same angle, allows the anode to be positioned in the hole with ample ground between the pipeline and the anode so that an acceptable voltage potential is developed between the pipeline and the anode. A voltage potential is necessary for the galvanic reactions to occur so that the pipeline is cathodically protected and the anode is sacrificed. In this way, the present invention provides for the placement of an anode to efficiently protect a steel pipeline, while avoiding the excessive time, cost and disruption associated with present techniques which require penetration of a road surface to place such an anode.

DETAILED DESCRIPTION OF THE PREFERRED EMBODIMENT(S)

Figure 1:
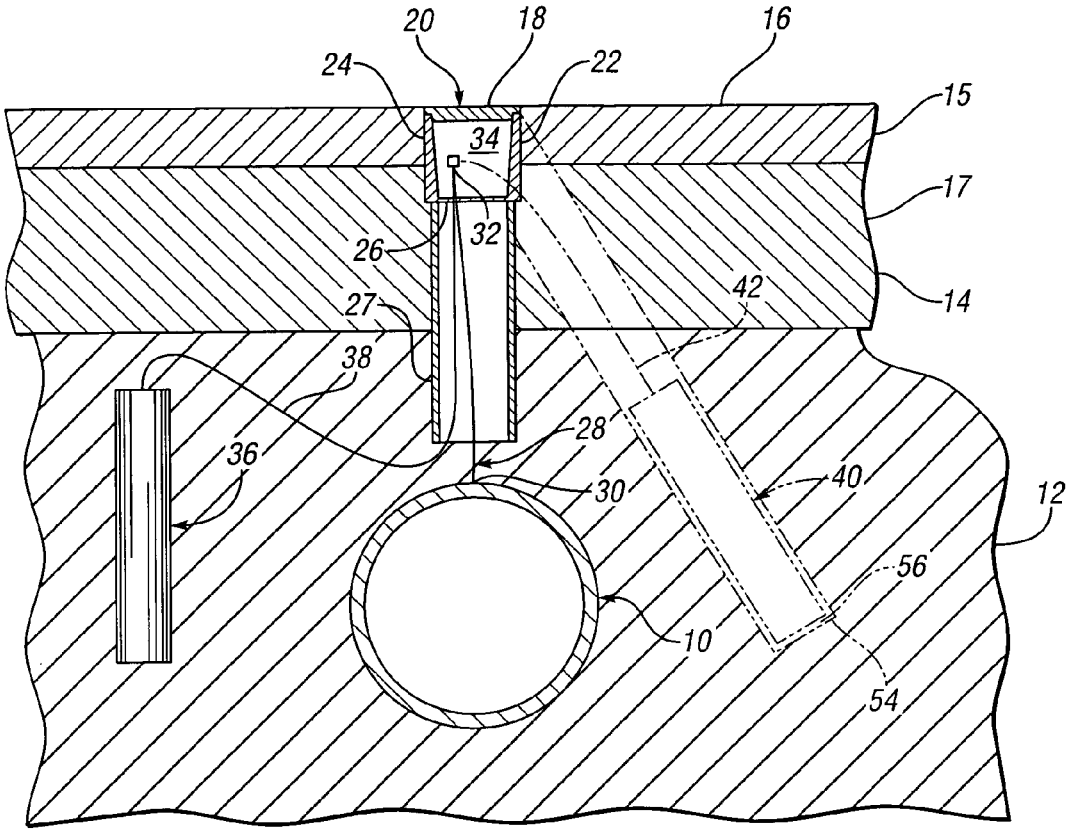
FIG. 1 shows a side sectional view of a pipeline connected to an existing anode and connected to a second anode installed by a method of the present invention.

FIG. 1 shows a cross section of a steel pipeline 10, typical of pipelines used in gas delivery systems. The pipeline 10 is buried in the soil 12, a portion of which is covered with a roadway 14, which includes a layer of asphalt 15 and a layer of concrete 17. In some places, the layer of asphalt 15 may be four or more inches thick, and the concrete 17 eight or more inches thick. The roadway 14 has a top surface 16, which is generally level with a top cover 18 of a container, or test box 20. The test box 20 is generally rectangular, with sidewalls 22, 24, and a bottom 26 shown in FIG. 1. In the embodiment shown in FIG. 1, the bottom 26 is generally open, which provides access to a pipe 27 penetrating into the soil 12. The pipe 27 may be integral with the test box 20, or it may be a separate component. Although the test box 20 is rectangular, other containers useful with the present invention may have different configurations. For example, other containers may have more or less than four sidewalls, and there may be little or no distinction between the sidewalls and the bottom of the container. Indeed, some containers may have no bottom at all. Attached to the pipeline 10 is an electrically conductive apparatus, or wire 28. The wire 28 has one end 30 attached to the pipeline 10, and another end 32 terminating in an interior 34 of the test box 20.

In the embodiment shown in FIG. 1, a method of the present invention will be used in an environment where a first anode 36 has previously been buried in the soil 12, and electrically connected to the pipeline 10 via a wire 38 which is connected to the wire 28 in the interior 34 of the test box 20. It is worth noting that the present invention is not limited to such an application, and can be used to place anodes where no anode was previously used. Moreover, although the embodiment shown in FIG. 1 uses a wire 28 as the electrically conductive apparatus disposed between the pipeline 10 and the test box 20, any electrically conductive apparatus suitable to provide an adequate electrical connection to the pipeline 10 may be used.

Also shown in phantom in FIG. 1 is a second anode 40, having a wire 42 connected thereto, and further connected to the wires 28 and 38 inside the test box 20. The present invention can be used to place the second anode 40 in the soil 12. As noted above, a method of the present invention contemplates accessing the soil 12 via the test box 20, so that the top surface 16 of the roadway 14 does not need to be penetrated. To place the anode 40 in the soil 12, the cover 18 of the test box 20 is removed. The wires 28 and 38, which were terminated in the interior 34 of the test box 20 prior to the placement of the second anode 40, are conveniently moved to one side, to provide unimpeded access to the sidewall 22 and bottom 26 of the test box 20.

Figure 2:
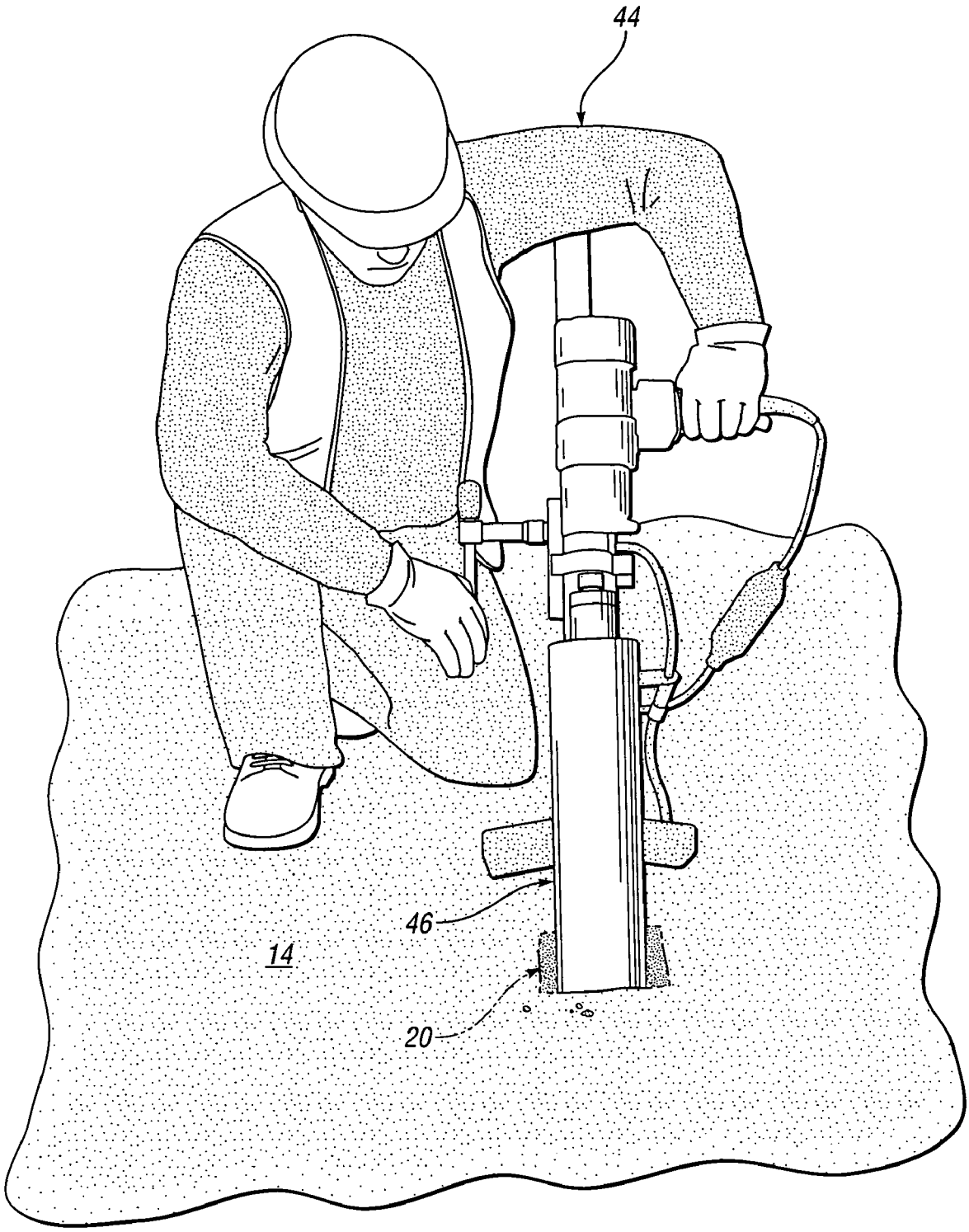
FIG. 2 shows an operator using a core drill to create a hole for the anode by accessing the ground through an existing test box.

FIG. 2 shows an operator 44 carrying out a portion of a method in accordance with the present invention. The lid 18, shown in FIG. 1, has been removed from the test box 20, and a core drill 46 has been inserted into the interior 34 of the test box 20. As shown in FIG. 2, the core drill 46 is easily operated by a single individual, who may otherwise be breaking a large portion of the roadway 14 with a jack hammer, or other impact tool. Use of the core drill 46 provides another advantage over traditional jack hammers and impact tools, in that the core drill 46 provides a generally constant diameter bore for the placement of an anode, such as the anode 40 shown in FIG. 1. Core drill bits are available in different sizes, allowing the diameter of the hole to be chosen based on the requirements of the particular application.

In addition to the other advantages, the present invention typically generates far less debris than conventional anode placement techniques. For example, the core drill 46 will penetrate the test box 20, and perhaps some of the pipe 27 extending down from the test box. In addition, as more clearly illustrated in FIG. 3, the core drill 46 penetrates the roadway 14, including the asphalt 15 and/or the concrete 17. The amount of roadway material removed is relatively small, and may be readily extracted from the core drill 46 as a plug of material. This is in contrast to using a backhoe or other piece of heavy equipment to remove the broken road surface and debris generated during conventional anode placement techniques.

Figure 3:
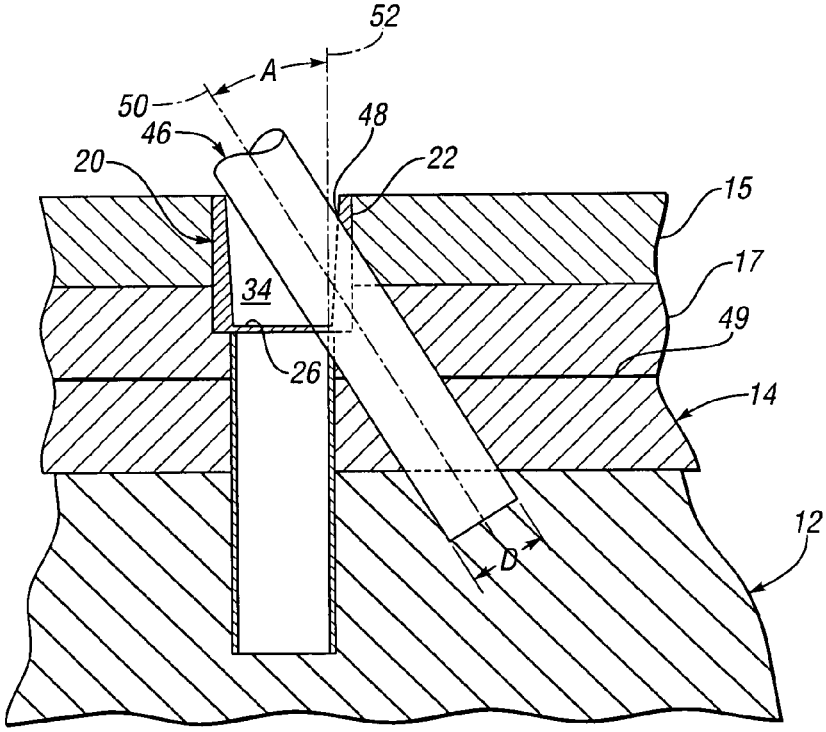
FIG. 3 shows a partially schematic side sectional view of the core drill penetrating the sidewall and bottom of the test box and the ground proximate the test box.

FIG. 3 shows a schematic representation of the core drill 46 as it penetrates the test box 20 and the roadway 14. As shown in FIG. 3, the core drill 46 not only penetrates the sidewall 22 of the test box 20, it also cuts through some of the asphalt 15 and the concrete 17. Embedded in the concrete 17 is a layer of wire mesh 49, which can be cut by the core drill 46 with relative ease. This is in contrast to conventional excavation techniques using a jack hammer or other impact tool, all of which are poorly equipped to handle metal in concrete. This is even more pronounced when concrete is filled with rebar. Thus, use of the core drill 46 facilitates fast and efficient penetration of the test box 20 and roadway 14.

The hole bored in the test box 20 facilitates access to the ground proximate the test box 20, including an undersurface portion of the roadway 14 and the soil 12, without having to penetrate the top surface 16 of the roadway 14. Once the soil 12 is accessible, the soil material—i.e. dirt, sand, small rocks, etc.—can be removed by any technique effective to provide a location for placement of an anode, such as the anode 40 shown in FIG. 1. For example, the soil material can be vacuum excavated. Alternatively, the soil material can be dug out, for example, using a "valve box cleaning tool" known to those in the gas industry. The valve box cleaning tool resembles a small posthole digger, and allows soil material to be removed through the hole bored in the test box 20 and roadway 14.

As shown in FIG. 3, the core drill 46 has a longitudinal axis 50 which is oriented at an oblique angle (A) from a vertical axis 52. Although the angle (A) may be chosen to be any angle effective to provide the desired orientation of the anode to be installed, an angle of between approximately 25° and approximately 35° has been found to be effective. Orienting an anode with this angle provides a number of advantages. First, it allows a diameter (D) of the core drill 46, and the associated hole 48, to be relatively large while still fitting within the interior 34 of the test box 20. For example, a test box, such as the test box 20, may approximate a cubic structure having a linear dimension of about 6 inches. The diameter (D) of the core drill 46 may be 4 to 5 inches in order to accommodate a large anode rod, such as the anode 40. Also, if the core drill 46 were oriented vertically in the test box 20, it would likely interfere with any wires that were already terminated inside the test box 20—see, e.g., wires 28, 38 in FIG. 1.

After the core drill 46 penetrates the test box 20 and the roadway 14, material from the soil 12 is removed as describe above. This creates a hole 54 of a certain depth in the soil 12—see FIG. 1. The hole 54 is slightly larger than the anode 40, which facilitates placement of the anode 40 in the soil 12. As shown in FIG. 1, an open space 56 may remain in the hole 54 after the anode 40 is placed in its position. The open space 56 can then be filled with a material such as bentonite—an electrically conductive clay material, formed from volcanic ash. By using bentonite, or some other electrically conductive material or materials as a backfill, good electrical conductivity is facilitated between the anode 40 and the soil 12. This facilitates an efficient galvanic reaction between the pipeline 10 and the anode 40, thereby protecting the pipeline 10 from corrosion.

Because the ability of the anode 40 to protect the pipeline 10 from corrosion is related to the surface area of the anode 40, it may be beneficial to use a relatively large rod, for example, a rod at least 24 inches long, and having a transverse dimension of at least 4 inches. Such a rod does not need to be perfectly square or round, but rather, can have a cross section represented by an irregular polygon. As noted above, once the anode 40 is placed in the hole 54, and the backfill is used to fill the open space 56, the wire 42 is connected to at least the wire 28 from the pipeline 10. The cover 18 is then replaced on the test box 20, and the entire process has been performed with a significant reduction in time, cost and environmental disturbance as compared to conventional anode installation techniques.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for managing corrosion of an underground structure, the underground structure including a pipeline having an electrically conductive apparatus electrically connected to it, at least a portion of the electrically conductive apparatus being disposed in a container at least partially disposed below ground, the container including a wall and a removable cover for selectively covering and providing access to an interior of the container, the method comprising:

removing the cover of the container;

boring a hole through the wall of the container, the boring being initiated from the interior of the container;

removing material from the ground proximate the container through the hole in the wall, thereby creating a hole of a certain depth in the ground adjacent the container without having to penetrate a top surface of the ground proximate the container;

inserting at least partially into the hole of the certain depth a sacrificial anode for the pipeline, the anode being inserted into the hole of the certain depth from the interior of the container, thereby effecting placement of the anode in the ground adjacent the container without having to penetrate a top surface of the ground proximate the container; and electrically connecting the anode to the electrically conductive apparatus such that the anode provides corrosion protection for the pipeline.

2. The method of claim 1, wherein the hole of the certain depth is created at an oblique angle to a vertical axis such that sufficient material is provided between the anode and the pipeline to facilitate a desired electrical potential therebetween.

3. The method of claim 2, wherein the hole is bored through the wall of the container at an angle to the vertical axis of between approximately 25 degrees and approximately 35 degrees.

4. The method of claim 1, wherein the hole of the certain depth includes at least some open space after the anode is inserted, the method further comprising filling at least some of the open space with an electrically conductive material.

5. The method of claim 1, the electrically conductive apparatus including a first wire having an end terminating in the container, and wherein the step of electrically connecting the anode to the electrically conductive apparatus includes connecting a second wire to the anode and to the first wire.

6. The method of claim 1, wherein the anode is configured as a rod having a longitudinal dimension of at least 24 inches and a transverse dimension of at least 4 inches, thereby providing a large anodic surface area for the pipeline.

7. The method of claim 6, wherein the hole is bored through the wall of the container using a core drill, thereby creating a hole at least four inches in diameter.

8. The method of claim 7, the ground proximate the container including a layer of roadway material, and wherein the step of removing material from the ground proximate the container includes boring through the roadway material using the core drill.

9. The method of claim 7, wherein the step of removing material from the ground proximate the container includes at least one of vacuuming out at least some of the material or digging out at least some of the material.

10. A method for managing corrosion of an underground structure, the underground structure including a pipeline having a first sacrificial anode electrically connected thereto, the pipeline having an electrical conductor electrically connected to it, at least a portion of the electrical conductor being disposed in a test box at least partially disposed below ground, the test box including a wall and a removable cover for selectively covering and providing access to an interior of the test box, the method comprising:

removing the cover of the test box;

creating a hole of a certain depth in the ground proximate the container by boring through the wall of the test box from the interior of the test box, and removing material from the ground proximate the test box through the bored hole, the hole of the certain depth being created without having to penetrate a top surface of the ground proximate the container;

disposing at least partially within the hole of the certain depth a second sacrificial anode for the pipeline; and electrically connecting the second anode to the electrical conductor such that the second anode provides corrosion protection for the pipeline.

11. The method of claim 10, wherein the hole of the certain depth includes at least some open space after the second anode is at least partially disposed therein, the method further comprising filling at least some of the open space with an electrically conductive material.

12. The method of claim 10, wherein the hole of the certain depth is created at an oblique angle to a vertical axis such that sufficient material is provided between the second anode and the pipeline to facilitate a desired electrical potential therebetween.

13. The method of claim 12, wherein the hole is bored through the wall of the test box at an angle to the vertical axis of between approximately 25 degrees and approximately 40 degrees.

14. The method of claim 10, wherein the hole is bored through the wall of the test box using a core drill to create a hole at least four inches in diameter.

15. The method of claim 14, the test box being disposed in a portion of a street or sidewalk, and wherein removing material from the ground proximate the test box includes boring through the street or sidewalk using the core drill.

16. The method of claim 14, wherein the step of creating the hole of the certain depth includes at least one of vacuuming out or digging out at least some of the material from the ground proximate the test box.

17. A method for managing corrosion of an underground structure having a first electrically conductive apparatus electrically connected thereto, at least a portion of the first electrically conductive apparatus being disposed in a container that is at least partially below ground, the container having an interior which is at least partially defined by a wall, the method comprising:

accessing the interior of the container, thereby providing access to the wall and the first electrically conductive apparatus;

creating a hole in the wall of the container, thereby providing access to the ground proximate the container adjacent the hole in the wall;

creating a hole of a certain depth in the ground proximate the hole in the wall by accessing the ground through the hole in the wall from the interior of the container, thereby creating the hole of the certain depth without having to penetrate a top surface of the ground proximate the container;

disposing at least partially within the hole of the certain depth a second electrically conductive apparatus including a material capable of acting as a sacrificial anode relative to the underground structure; and electrically connecting the first and second electrically conductive apparatuses to each other such that the second electrically conductive apparatus provides corrosion protection for the underground structure.

18. The method of claim 17, the first electrically conductive apparatus including a first wire having an end terminating in the container, and wherein the step of electrically connecting the first and second electrically conductive apparatuses to each other includes connecting a second wire to the second electrically conductive apparatus and to the first wire.

19. The method of claim 17, wherein the step of creating a hole in the wall of the container includes boring the hole using a core drill.

20. The method of claim 17, wherein the step of creating the hole of the certain depth includes at least one of vacuuming out or digging out material from the ground proximate the container.

* * * * *